United States Patent [19]

Lhenry et al.

[11] 4,098,495

[45] Jul. 4, 1978

[54] METHOD OF AND APPARATUS FOR QUENCHING SHEET METAL

[75] Inventors: Bernard Lhenry; Michel Toitot; Régis Blondeau, all of Le Creusot, France

[73] Assignee: Creusot-Loire, Paris, France

[21] Appl. No.: 629,092

[22] Filed: Nov. 5, 1975

[30] Foreign Application Priority Data

Nov. 22, 1974 [FR] France ..... 74 38378

[51] Int. Cl.[2] ..... C21D 9/46

[52] U.S. Cl. ..... 266/115; 134/122 R; 134/199; 148/153; 266/113

[58] Field of Search ..... 134/15, 122, 151, 199; 148/143, 153; 266/111, 113, 114, 115

[56] References Cited

U.S. PATENT DOCUMENTS

| | | | |
|---|---|---|---|
| 2,271,372 | 1/1942 | Herman et al. | 266/113 X |
| 3,423,254 | 1/1969 | Safford et al. | 260/113 X |
| 3,428,023 | 2/1969 | Cox et al. | 134/15 X |
| 3,554,513 | 1/1971 | Chonce | 266/113 |
| 3,659,428 | 5/1972 | Kunioka et al. | 266/113 X |
| 3,885,581 | 5/1975 | Dahan et al. | 134/199 X |

*Primary Examiner*—Gerald A. Dost
*Assistant Examiner*—Paul A. Bell
*Attorney, Agent, or Firm*—Haseltine, Lake & Waters

[57] ABSTRACT

In the quenching of sheet metal, the sheet metal is passed through a stream of quenching fluid in the form of an aerosol and which is caused to flow in a direction perpendicular to the direction of passage of the metal sheet and parallel to the general plane of the metal sheet.

8 Claims, 10 Drawing Figures

METHOD OF AND APPARATUS FOR QUENCHING SHEET METAL

The present invention refers to a method of and apparatus for quenching sheet metal.

The invention is applicable to sheet steel which after rolling and passing through a roll-furnace is advantageously treated by rapid quenching and tempering. Thus it is applicable to the treatment of sheets of weldable steel of high elastic limit, low alloy steel, sheets of steel of high hardness, sheets of steel for use at low temperatures, etc. In particular it enables quenching of sheets of intermediate and great thicknesses.

With cooling, the metastable austenite in a carbon steel can decompose in several phases depending upon the rate of cooling. With high rates of cooling a martensitic structure is obtained, with less high cooling rates a bainitic type of structure is obtained. The result is an increase in the elastic limit. The quenchability of the steel is primarily a function of the austenite, in particular of the size of the austenitic grain and of the elements in solution in the austenite. Additions of elements such as nickel, manganese, molybdenum, chromium, and boron are employed to improve the quenchability. It is possible to calculate the gain in additives which is enabled by the achievement of a rapid quench. By way of example, for a 20 mm sheet, going from a quench by spraying to a quench by immersion is equivalent to a reduction of 1% in the content of chromium or to a reduction of 0.9% in the content of nickel or to a reduction of 0.75% in the content of molybdenum. One can understand there is great interest in having available a rapid-quenching installation for the treatment of low or intermediate alloy steels.

A number of methods and devices are known for the purpose of enabling quenching of sheets.

A first type of installation effects the quench by spraying the sheets. In this installation atomized water under pressure from nozzles is directed onto the top and bottom faces of the sheet while it is translated. This installation has two disadvantages. The cooling rate is in fact insufficient, which only enables steels to be treated which contain a relatively large amount of quenching elements. This installation is therefore unsuited to the quenching of low alloy steels displaying good welding characteristics.

Important improvements have been obtained with the development of roll-quenching installations which have enabled martensitic quenching of steels of low quenchability and therefore more weldable. A first roll-quenching installation is described in French Pat. No. 1 415 912. It comprises driven rolls which cause a constant displacement of the sheet, so ensuring more rapid and uniform cooling of it. The rolls are arranged on opposite sides of the sheet so as to minimize the risk of distortion. The quench is effected by means of high-pressure water atomizer banks arranged between the rolls. Improvements in the above installation, which are described in French Pat. Nos. 1 471 847 and 1 506 919, enable more uniform application of the quench water by employing hooped rolls. French Pat. No. 1 506 919 describes an installation including hooped rolls between which the sheet passes and means ensuring the atomization of the cooling water at the input to the installation. The curtain of water strikes the sheet at a slant so that the fluid is exhausted towards the output by passing between the hoops on the rolls. The jets of water are directed against the sheet between the rolls nearly perpendicularly and at high pressure in order to avoid the heating which causes the formation of a film of steam and in order to avoid stagnation of the water. The flow of water is large, which necessitates a storage tank of high capacity and a high power pumping installation. In order to avoid plugging by scale of the water-ejector nozzles which must maintain full efficiency, certain steelmakers have found it useful to heat the sheets in controlled-atmosphere furnaces, which avoids the formation of scale but increases the investment cost. In addition to the aforesaid disadvantages this installation has the disadvantage of causing maximum cooling between the rolls, at the place where the sheet is free. This sometimes leads to local deformation of the sheet. Flattening operations are then difficult and costly.

In French Pat. No. 1 061 650 it is proposed to quench a sheet by subjecting it to tensile stress during its displacement and directing atomized cooling fluid against the two faces of the sheet. The cooling jets are directed perpendicularly against the faces of the sheet. The majority of the disadvantages of roll-quench installations are encountered again with this installation.

The installation described in French Pat. No. 2 120 966 achieves the quench by a plurality of nozzles providing a fog of water, these nozzles being arranged on opposite sides of the sheet and slightly tilted in the direction of movement of the sheet.

French Pat. No. 2 217 425 describes a rapid-quench installation in which the sheet is placed under tensile stress while a cooling fluid circulates transversely in contact with the two faces of the sheet. The lateral positioning of the devices for production and exhaust of the cooling fluid and the transverse circulation of the fluid are favourable to homogeneity of cooling.

Use of the method and installation in accordance with the invention can enable sheets to be quenched at a high cooling rate without employing very large cooling fluid flows. The increases in the efficiency of quench enables, with constant sheet composition, the thickness of sheets capable of being quenched to be increased and, with constant characteristics and thicknesses the content of carbon and alloying elements to be reduced in significant proportions. This reduction in the alloying elements and the carbon content causes a substantial improvement in the weldability of the steels treated and enables gradations of steel to be produced which are vey weldable and have high elastic limits. Use of the method and installation in accordance with the invention can provide a quench of great homogeneity, which enables greater homogeneity of characteristics to be obtained in unstable gradations. The method and installation in accordance with the invention can enable products to be obtained which have very high flatness. This improvement enables a significant reduction in flattening and pre-flattening, which brings about a reduction in manufacturing time and a reduction in the residual stresses introduced by these operations, which stresses cause deformation during cutting and reduce the pliability. The method and installation in accordance with the invention can enable steel sheets to be treated and with a given composition higher mechanical characteristics to be obtained without significant deformations or with deformations in regular surfaces which are easy to flatten.

In accordance with the invention there is provided a method of quenching sheet metal comprising forming at least one stream of a cooling fluid and passing the flat sheet through the stream in a direction perpendicular to the direction of flow of the fluid stream wherein the fluid is an aerosol.

The sheet may be subjected to a tensile stress perpendicular to the direction of flow of the aerosol before the sheet leaves the aerosol stream.

Advantageously turbulence is created in the aerosol stream.

The flow of the aerosol stream may be caused by the creation of a reduced pressure downstream of the stream and/or by an increased pressure upstream.

Injection of at least one fluid constituent of the aerosol may be provided at at least one intermediate point in the path of the aerosol stream.

At least two aerosol streams may be provided adjacent to one another, both of which are traversed by the sheet.

The invention will be more fully understood from the following description of embodiments thereof, given by way of example only, with reference to the accompanying drawings. In the drawings.

Figure 1:
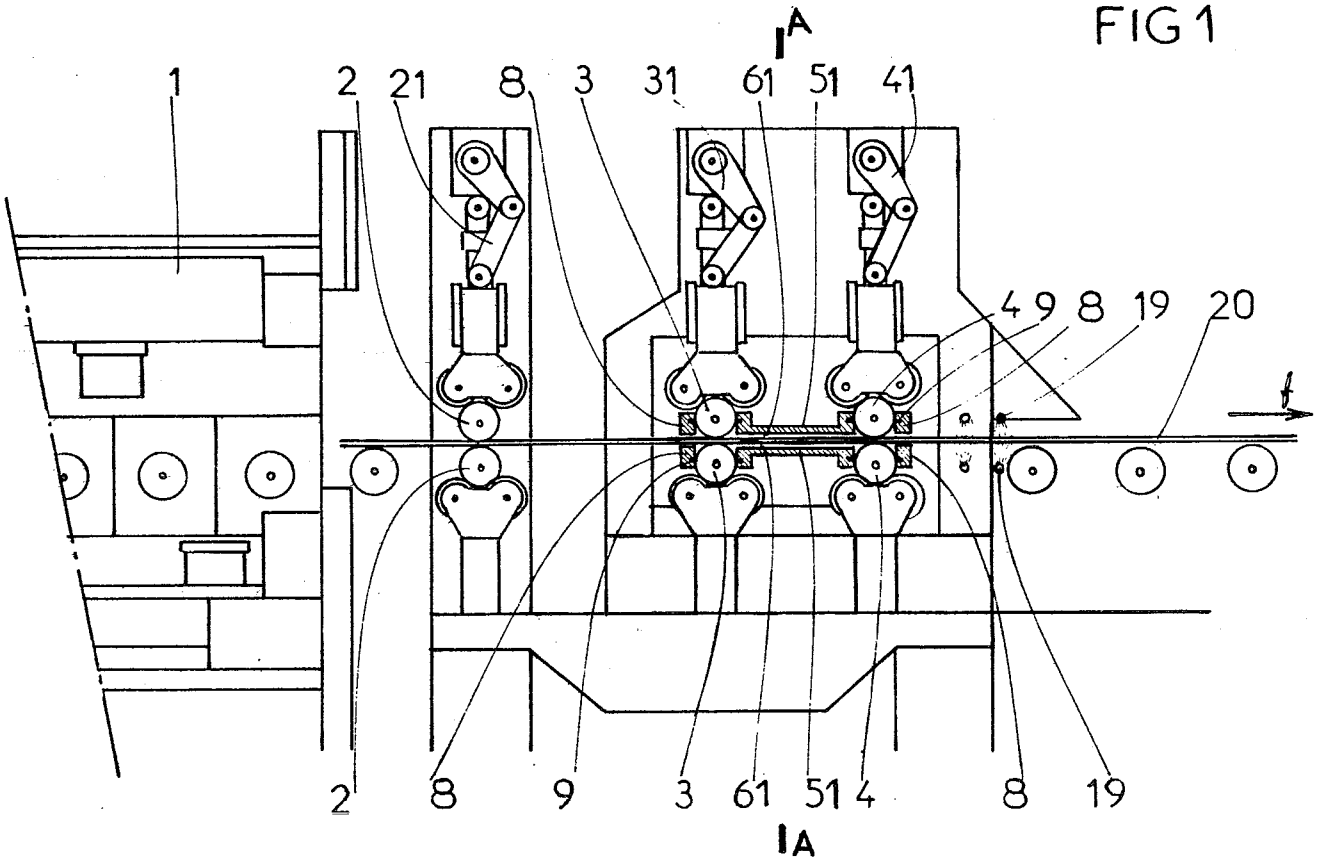
FIG. 1 is a section in the direction of displacement of the sheet to be quenched of one embodiment of an installation in accordance with the invention.

The quenching installation illustrated in FIG. 1 is arranged at the output from a roll furnace 1, with the sheet 20 to be treated being displaced in the direction of the arrow *f*.

Introduction of the sheet into the quenching installation is ensured by introducer-rolls 2.

The quenching fluid is channelled into an airtight enclosure or chamber 61 through which the sheet passes in such a way that both faces of one and the same portion of the sheet are subjected to the quenching fluid. The sheet enters the enclosure between a pair of rolls 3 and leaves the enclosure between a pair of rolls 4. The enclosure is furthermore bounded by housings 51 each located between one of the rolls 3 and one of the rolls 4 on one side of the plane of travel of the sheet and by housings 8 located upstream and downstream of the rolls 3 and 4. Seals 9 are mounted in the housings 8 and 51 and rub against the rolls thereby contributing to the airtightness of the chamber 61. One at least of the rolls of each pair of rolls 3 and 4 is movable vertically and is subject to a tightener mechanism 31 and 41 respectively which ensures the adhesion of the said roll to the sheet and the airtightness of the enclosure forming the chamber 61. In order that the rolls should not roll the hot sheet the tightening pressure is controlled. The pair of rolls 2 located between the furnace and the pair of rolls 3 ensures guidance of the sheet facilitating its introduction into the quenching chamber 61 of the installation, the application of the rolls to the sheet being ensured by mechanism 21.

The cooling fluid is divided, when the sheet is passing through the chamber, into an upper stream and a lower stream. The cooling fluid circulates perpendicularly to the direction of displacement of the sheet, that is to say, it circulates in the direction of the width of the sheet parallel to the axes of the rolls 3 and 4. As shown in FIGS. 3 to 10 the housings 51 are laterally joined by a housing 53 which forms a chamber 612 in which is produced all or a portion of the cooling fluid. At the other side of the chamber, downstream with respect to the direction of circulation of the cooling fluid, there is provided an outlet 611 for exhaust of the cooling fluid.

The cooling at the outlet of the chamber 61 is completed by atomized cooling fluid from atomizers 19.

The circulation of the cooling fluid in chamber 61 thus induces substantially no force on the sheet. A judicious choice of the fluid enables identical exchanges to be obtained on opposite sides of the sheet, which suppresses any deformation of thermal origin. In fact the thermal stresses which arise during cooling are opposed.

The cooling fluid is an aerosol which is preferably formed by fine particles of water as far as the liquid phase is concerned and by air or steam as far as the gaseous phase is concerned. The ratio of the liquid mass to the gaseous mass should advantageously remain within the limits of 3 to 9. The efficacy of the cooling fluid is due in part to the exceptional extent of the latent heat of vaporization which, taking into consideration the heating of the particles of water, absorbs 610 kilocalories (2.6 million joules) per kilogram of water. This value is considerable, taking into consideration the small amounts of heat extracted by homogeneous fluids (for example, 10 kilo-calories per kilogram of water for an increase in the temperature of the water by 10° C). Speeds of circulation of the aerosol between 10 and 40 m/s are advantageous.

Figure 3:
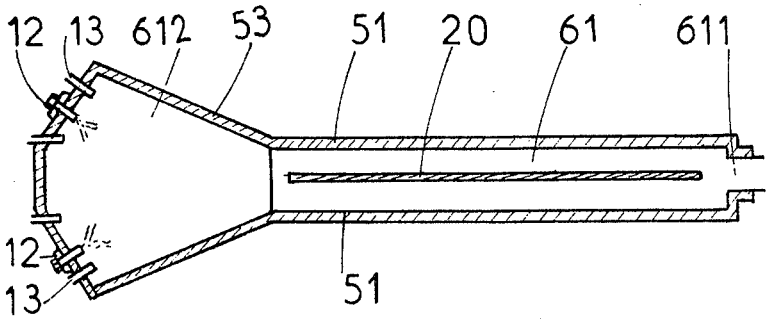
FIGS. 3 to 10 are sections along the line A—A in FIGS. 1 and 2 showing different means for the production and circulation of the cooling fluid.

In the embodiment illustrated in FIG. 3 the aerosol is produced in the chamber 612. The liquid phase of the aerosol is distributed in the form of mist by atomizers 12 fed with liquid under pressure. The gaseous phase which is provided by atomizers 13 serves to bring the aerosol exhausted through the outlet 611 to an increased pressure to cause circulation of the aerosol. In this embodiment the speed of cooling of the sheet adjacent the outlet is lower than the speed of cooling adjacent the inlet.

Figure 4:
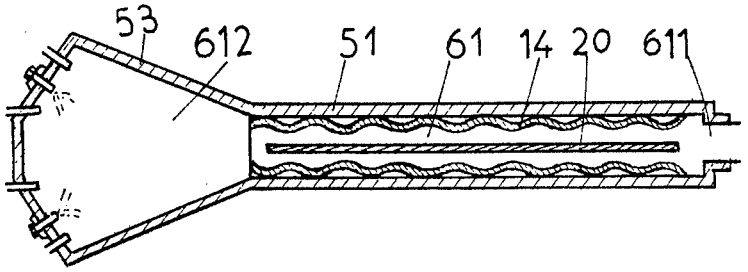

The embodiment illustrated in FIG. 4 improves the efficiency of cooling. Means are provided for causing turbulence in the aerosol in the chamber 61. As shown these means consist of mechanical impellers 14 arranged on the inner walls of the housings 51. Other means may be provided. The creation of turbulence is advantageous to increase the number of droplets which strike the sheet within a given time and extract the calories by instantaneous evaporation without heating up. The efficiency of the cooling is thus improved.

In the embodiments of FIGS. 3 and 4 the liquid phase vaporizes in proportion as the aerosol advances. The ratio of the liquid mass to the gaseous mass is modified.

Figure 5:
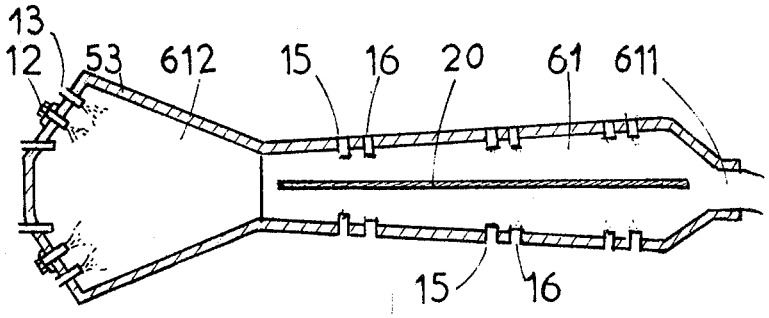
Figure 6:
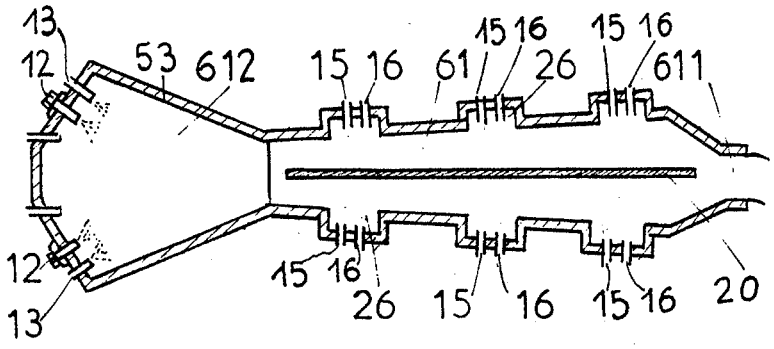

The embodiment illustrated in FIG. 5 enables the ratio of the liquid mass to the gaseous mass to be modified along the stream and the efficiency of the thermal exchanges to be kept substantially constant. The homogeneity of the cooling is thus improved. Injectors 15 and 16 are provided for injecting the liquid and/or the gas constituting the aerosol into the chamber 61. These injectors are arranged symmetrically with respect to the sheet in order that the cooling should be symmetrical. The injections of liquid and/or gas increase the volume of the aerosol in proportion to its advance. If necessary a progressive variation in the cross-section of the chamber 61 can be provided in the direction of advance. One portion of the aerosol is, as in the preceding embodiments, produced in the chamber 612, the atomizers 13 providing the increased pressure.

In the embodiment illustrated in FIG. 6 again one portion of the aerosol is generated in the chamber 612. Additional injections of liquid and/or gas are provided by atomizers 15 and 16 along the path of the aerosol. Baffles 26 arranged or inserted in the housings assist the turbulence. The circulation of the aerosol is caused by the increased pressure prevailing in the chambers 612 and 61.

In the preceding embodiments the increased pressure which causes the circulation of the fluid brings about leakage of aerosol to the outside.

In the embodiments illustrated in FIGS. 7 to 10 the circulation of the aerosol is caused by creation of a reduced pressure at the outlet by means of a multi-stage steam-ejector 17. The seals then have the object of avoiding entry of air into the chamber 61. Known means (not shown), which serve to eliminate particles of the liquid fluid contained in the aerosol, may be introduced between the outlet and the steam-ejector in order to enable better operation of the latter.

The circulation may alternatively be caused both by creation of a reduced pressure at the outlet from the chamber 61 and by creation of an increased pressure at the inlet to this chamber.

Figure 7:
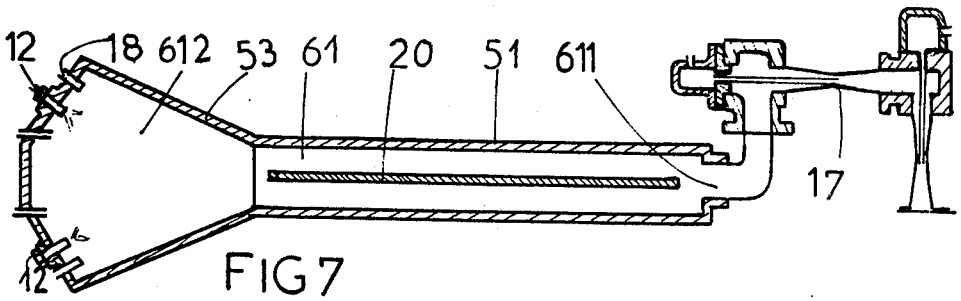

In the embodiment illustrated in FIG. 7 the liquid phase of the aerosol is formed in the chamber 612. Air inlets 18 provide the gaseous phase.

Figure 8:
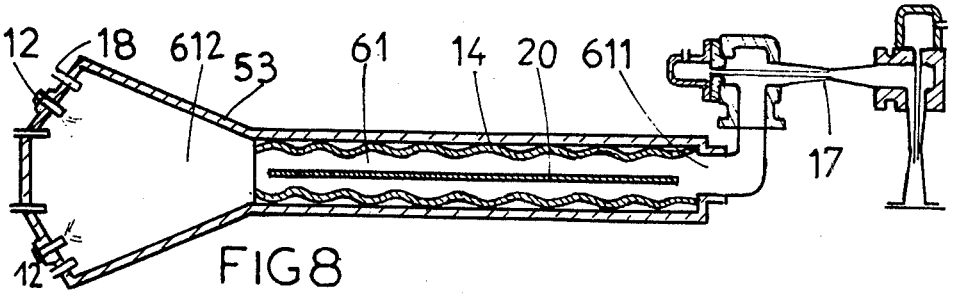

In the embodiment illustrated in FIG. 8 the production of the aerosol and the circulation of the aerosol are caused in the same way but mechanical impellers 14 increase the turbulence of the aerosol.

Figure 9:
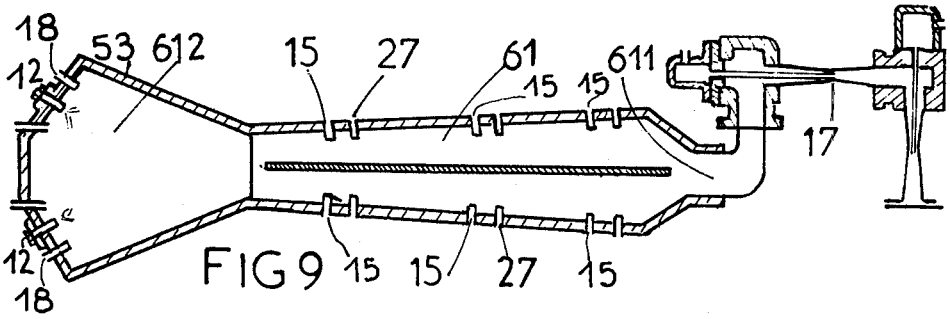

In the embodiment illustrated in FIG. 9 additional injections of at least one aerosol phase are obtained by atomizers 15 provided in the chamber 61, one portion of the aerosol being produced in the chamber 612. Air inlets 27 are provided if necessary.

Figure 10:
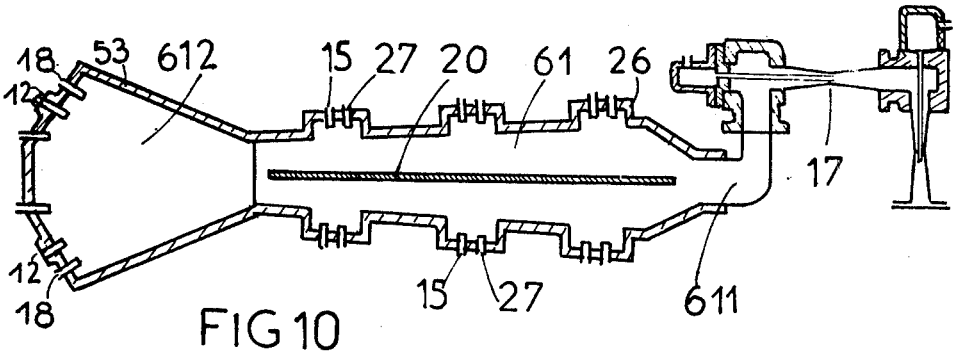

In the embodiment illustrated in FIG. 10 injections by atomizers 15 are provided and means of increasing the turbulence are likewise provided in the stream, the circulation of which is caused by the steam-ejector 17.

Figure 2:
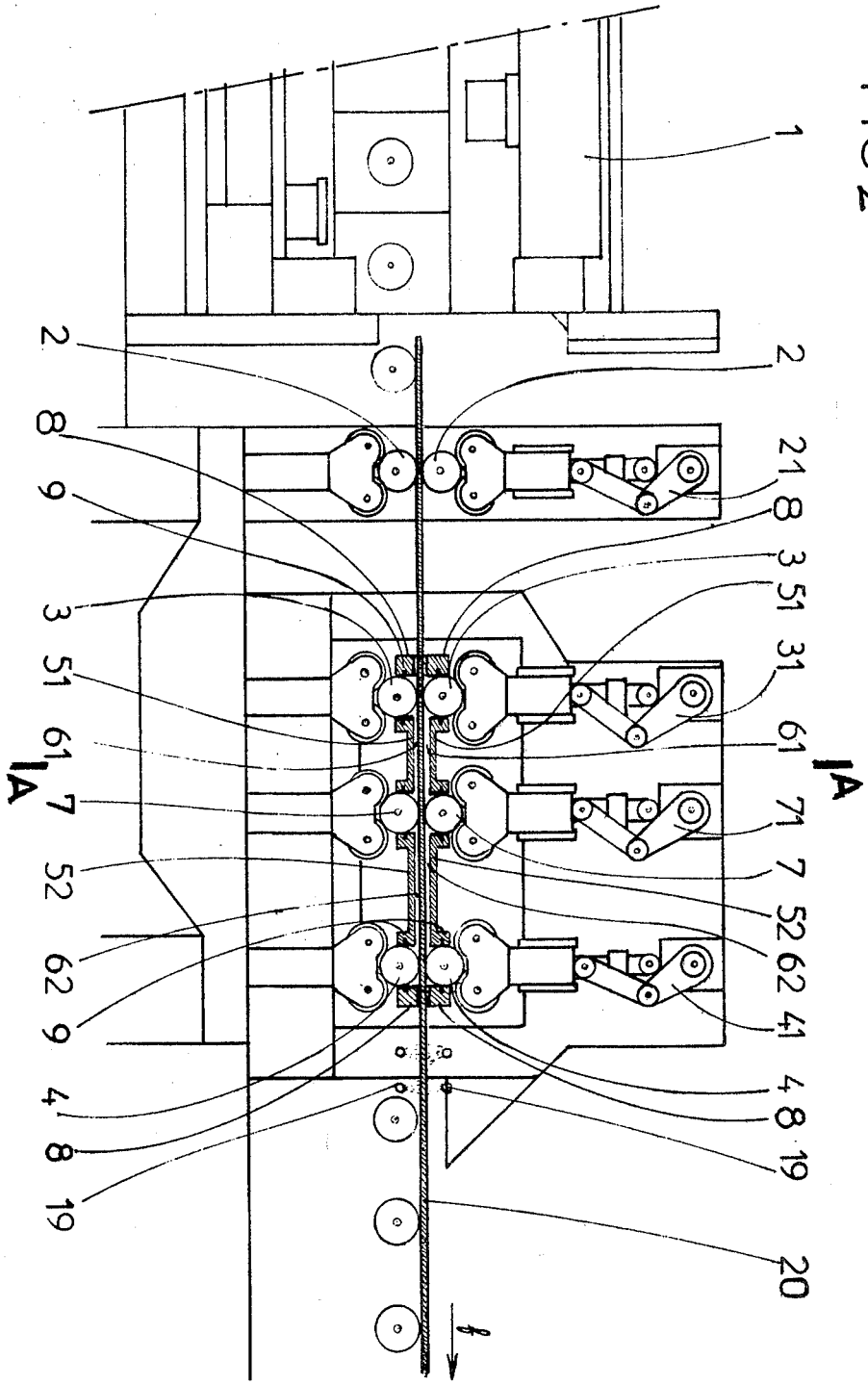
FIG. 2 is a section in the direction of displacement of the sheet to be quenched of another embodiment of an installation in accordance with the invention.

In the embodiment illustrated in FIG. 2 the device includes at least two chambers 61 and 62 in each of which an aerosol circulates perpendicularly to the direction *f* of movement of the sheet. The chamber 61 is bounded by a pair of upstream rolls 3, the housings 51 located above and below the sheet, a lateral housing 53 and a lateral outlet 611, these two latter elements being illustrated in FIGS. 3 to 10. The chamber 62 is bounded by a pair of downstream rolls 4, housings 52 located above and below the sheet, a lateral housing similar to the housing 53, and a lateral outlet similar to the outlet 611. The chambers 61 and 62 are preferably separated by intermediate rolls 7 applied against the sheet by a mechanism 71. The first chamber 61 is provided for achieving a very vigorous cooling in order to obtain a black sheet, that is to say, a sheet the surface of which reaches less than 200° C, the speed of cooling being governed by the thermal impedance of the sheet. The chamber 62 is intended to follow up the thermal exchange from the black sheet. The thermal flux exchanged is weaker, which provides economy of energy. The two zones exchange as many calories on the average but the length of the chamber 62 is greater than that of the chamber 61. The characteristics of the aerosol, the circulation of this aerosol and the turbulence of the aerosol may be different in the two chambers. Thus the ratio of the liquid mass to the gaseous mass of the aerosol circulating in the chamber 61 may be different from the corresponding ratio of the aerosol circulating in the chamber 62. The third cooling zone is provided simply by atomizers 19 which bring the sheet to a temperature enabling easier handling. The means of causing the formation of the aerosol, its turbulence and its circulation are similar to the means described with reference to FIGS. 3 to 10.

Operation of the device is as follows. The downstream end of the sheet passes between the rolls 2 and then between the rolls 3 into the chamber 61 where the aerosol is already circulating, and then, if provided, through the chamber 62. The downstream end of the sheet therefore undergoes a normal quench. In the same way the circulation of the aerosol continues until the upstream end of the sheet has left the rolls 4, so that the upstream end of the sheet is quenched normally.

The assembly consisting of the retainer rolls 3, the driving rolls 4, the intermediate rolls 7, if provided, the driving means for these rolls, the means defining the chamber 61 and the chamber 62, if provided, the means of production of the aerosol, the means of exhaust and of causing circulation of the aerosol may be fixed. Alternatively they may be mounted on a movable carriage. This carriage is then guided on rails parallel to the direction of movement (*f*) of the sheet and is manipulated along these rails by a jack in that direction of movement.

Quenching of the sheet must be effected upon a flat sheet. Flatness of the sheet may be brought about before the entry of the sheet into the first quench-chamber 61. To achieve this flattening a tensile stress may be applied to the sheet between the rolls 2 and the rolls 3. The stress in the sheet results from differential application of an adjustable torque between the rolls 2 and the rolls 3. The tensile stress applied to the sheet is calculated to obtain a predetermined elongation intended to keep the sheet flat before the action of the cooling fluid.

Flatness may also be brought about by placing the sheet under tensile stress in the quench-chamber 61 and in the second quench chamber 62, if provided. The stress in the sheet results in that case from differential application of an adjustable torque between the rolls 3 and the rolls 4. Flattening during the quench may be associated with flattening before the quench. Drive means (not shown) are coupled to the rolls in order to obtain the aforesaid torques.

We claim:

1. An apparatus for quenching sheet metal, the sheet metal having a predetermined plane of travel and comprising at least two pairs of rolls, each of the pairs of rolls having an axis, one at least of the rolls of each pair being movable vertically, means for applying at least one of said rolls of one said pair against said sheet metal, housing means located above and below the plane of travel of the sheet metal, said housing means being located each between two of the rolls, and including lateral housing means for forming an enclosure with at least said lateral housing means, said enclosure being formed with at least one lateral outlet for exhaust of a fluid, means for providing in said enclosure an aerosol having a liquid phase and a gaseous phase, for said aerosol to be divided into an upper stream and a lower stream, upon the sheet metal passing through the enclosure, and means for producing a pressure at one side of the enclosure for causing circulation of said aerosol in a direction parallel to the axes of the rolls.

2. An installation for quenching sheet metal comprising at least two pairs of rolls, means for applying at least one of said rolls of one said pair against said sheet metal, means associated with said rolls for defining at least one chamber through which said sheet metal, is passable and in which a cooling fluid can circulate transversely to the direction of passage of the sheet metal, means for exhausting said fluid and provided laterally of said chamber, means for producing said cooling fluid in the form of an aerosol, and means for putting said chamber under reduced pressure, said exhaust means being associated with the chamber pressure reducing means.

3. An apparatus as claimed in claim 1, comprising atomizers for additional injection of liquid along the said direction of circulation of said aerosol.

4. An apparatus as claimed in claim 1 wherein the pressure-producing means comprise at least one steam ejector disposed at the said lateral outlet for exhaust of a fluid.

5. An apparatus as claimed in claim 1 wherein said pressure producing means cause said gaseous phase of said aerosol to exert an increased pressure at said one side of the enclosure.

6. An apparatus as claimed in claim 1, wherein said housings are formed with inner walls, and further comprising baffles arranged on the inner walls of said housings for causing turbulence in said aerosol.

7. An apparatus for quenching sheet metal as claimed in claim 1, further comprising a movable carriage, said at least two pairs of rolls being mounted on said carriage, said carriage having a direction of movement parallel to the plane of travel of the sheet metal, and wherein at least one of the rolls of each of said pairs of rolls is movable vertically, the axes of said rolls being at right angles to the direction of movement of said carriage.

8. An apparatus for quenching sheet metal as claimed in claim 1, wherein the aerosol liquid and gaseous phases have first and second masses, respectively, the ratio of said liquid to said gaseous masses lying within a range of 3–9.

* * * * *